US009908135B2

(12) United States Patent
Eberle et al.

(10) Patent No.: US 9,908,135 B2
(45) Date of Patent: Mar. 6, 2018

(54) SPRINKLER PROTECTION

(71) Applicants: Myriam Kreipl, Untermeitingen (DE); Manfred Eberle, Illertissen (DE)

(72) Inventors: Manfred Eberle, Illertissen (DE); Oliver Kreipl, Untermeitingen (DE)

( * ) Notice: Subject to any disclaimer, the term of this patent is extended or adjusted under 35 U.S.C. 154(b) by 0 days.

(21) Appl. No.: 15/030,761

(22) PCT Filed: Oct. 21, 2014

(86) PCT No.: PCT/EP2014/072552
§ 371 (c)(1),
(2) Date: Apr. 20, 2016

(87) PCT Pub. No.: WO2015/059143
PCT Pub. Date: Apr. 30, 2015

(65) Prior Publication Data

US 2016/0263606 A1 Sep. 15, 2016

(30) Foreign Application Priority Data

Oct. 21, 2013 (DE) ..... 20 2013 009 315 U

(51) Int. Cl.
*A62C 25/00* (2006.01)
*B05B 15/00* (2018.01)
(Continued)

(52) U.S. Cl.
CPC ..... *B05B 15/001* (2013.01); *A62C 3/002* (2013.01); *A62C 35/68* (2013.01); *A62C 37/08* (2013.01); *B05B 1/265* (2013.01)

(58) Field of Classification Search
CPC ..... B05B 15/001; B05B 1/265; A62C 3/002; A62C 35/68; A62C 37/08
(Continued)

(56) References Cited

U.S. PATENT DOCUMENTS 1,075,053 A * 10/1913 Moore ..... E03B 9/20 239/24
3,361,364 A 1/1968 Purtell
(Continued)

FOREIGN PATENT DOCUMENTS

DE 25 10 649 A1 9/1976
DE 10 2008 046996 A1 3/2010
(Continued)

OTHER PUBLICATIONS

International Search Report & Written Opinion dated Mar. 5, 2015 corresponding to International Patent Application No. PCT/EP2014/072552 and partial English translation thereof.
(Continued)

*Primary Examiner* — Arthur O Hall
*Assistant Examiner* — Adam J Rogers
(74) *Attorney, Agent, or Firm* — Squire Patton Boggs (US) LLP

(57) ABSTRACT

The present invention relates to a protection device for protecting a baffle and/or a sprinkler head of a fire sprinkler system, wherein the protection device comprises a mounting portion for mounting to the sprinkler system and a protection portion adapted to at least partially surround the baffle and/or the sprinkler head, so that a damage to the baffle or the sprinkler head by placing stored goods into store or removing them from store can be prevented.

12 Claims, 8 Drawing Sheets

(51) Int. Cl.

| | |
|---|---|
| ***A62C 37/08*** | (2006.01) |
| ***A62C 3/00*** | (2006.01) |
| ***A62C 35/68*** | (2006.01) |
| ***B05B 1/26*** | (2006.01) |

(58) Field of Classification Search
USPC ..... 169/51
See application file for complete search history.

(56) References Cited

U.S. PATENT DOCUMENTS

| | | | | | |
|---|---|---|---|---|---|
| 3,514,040 | A * | 5/1970 | Carson | A01G 25/00 | 239/103 |
| 3,797,746 | A * | 3/1974 | Gray | A62C 37/08 | 169/37 |
| 5,632,339 | A * | 5/1997 | Fenske | A62C 37/11 | 169/37 |
| 5,893,418 | A * | 4/1999 | Ponte | A62C 31/02 | 169/37 |
| 5,961,248 | A * | 10/1999 | Tourtellotte | F16B 7/0493 | 403/385 |
| 9,320,927 | B2 * | 4/2016 | DeVaney | A62C 31/28 | |
| 2007/0131823 | A1 * | 6/2007 | Mominee | F16L 3/1016 | 248/62 |
| 2007/0256844 | A1 * | 11/2007 | Biasing | A62C 35/68 | 169/51 |
| 2008/0230238 | A1 * | 9/2008 | Jackson | A62C 35/68 | 169/41 |
| 2011/0017880 | A1 * | 1/2011 | Osborn | F16L 3/04 | 248/74.1 |
| 2011/0215566 | A1 * | 9/2011 | Stempo | A62C 35/68 | 285/144.1 |
| 2011/0290508 | A1 * | 12/2011 | Hunsberger | A62C 35/68 | 169/51 |
| 2011/0315409 | A1 * | 12/2011 | Silcox | A62C 35/68 | 169/51 |

FOREIGN PATENT DOCUMENTS

| | | |
|---|---|---|
| FR | 2 864 906 A1 | 7/2005 |
| KR | 100 821 215 B1 | 4/2008 |

OTHER PUBLICATIONS

Written Opinion of the International Preliminary Examining Authority dated Oct. 9, 2015 corresponding to International Patent Application No. PCT/EP2014/072552.

Notification of Transmittal of International Preliminary Report on Patentability & International Preliminary Report on Patentability dated Feb. 10, 2016 corresponding to International Patent Application No. PCT/EP2014/072552.

* cited by examiner

SPRINKLER PROTECTION

BACKGROUND

Field

The present invention relates to a protection device for a sprinkler system, in particular, to a protection device for protecting a baffle and/or a sprinkler head of a fire sprinkler system.

Description of the Related Art

Stationary sprinkler systems for racking systems, such as high bay racks, which comprise at least one shelf unit having several storage levels for placing stored goods thereon, typically consist of at least one bar pipe system with a predetermined number of sprinklers in predetermined storage levels, which open automatically in case of fire, of at least one common downcomer duct for the string pipe systems and of at least one extinguishing agent supply line system for the downcomer duct.

Such a stationary sprinkler system is disclosed in DE 25 10 649 A1, for example. Such fire extinguishing means are generally constructed so that string pipe systems with sprinklers, from which an extinguishing liquid leaks in case of fire, are allocated to particular storage levels of the shelf unit and that several extinguishing agent supply line systems are connected to the string pipe systems, which consist of one or several so-called string pipes, via so-called downcomers, to supply the latter ones with extinguishing agents. Considering the string pipes' assembly by sprinkles which maximum number depends on the so-called effective area in which sprinklers are opened in case of fire, the string pipes of the or several shelf units are combined to groups in a manner so that e.g. each shelf line or individual longitudinal portions of one or several shelf lines constitute a string pipe group consistent in itself.

Thus, such sprinkler systems are mounted in stockrooms at the ceiling or between and within shelf lines and are continuously kept under pressure. For release of the extinguishing liquid, the sprinklers comprise a sprinkler head and a baffle for deflecting or directing the escaping extinguishing liquid in a desired extinguishing direction.

However, in case of single and double lines of shelf rows, baffles are often deformed when the stored goods (such as e.g. pallets etc.) are placed into or respectively released from stock, so that the extinguishing agent (e.g. water) can no longer be distributed uniformly.

FIG. 7 shows a perspective view of a string pipe 40 with deformed sprinkler, the baffle 30 of which has been deformed by striking or other impact when placing the stored goods (e.g. cardboard packaging or the like) 60 into stock, so that the extinguishing agent which escapes from the sprinkler head 20 can no longer be distributed uniformly.

Furthermore, placing the stored goods into stock or respectively releasing it from stock may affect or even tear away sprinkler heads, which can cause damage or destruction of the stored goods by the escaboltg moisture.

FIG. 8 shows another perspective view of a storage shelf group with a supply pipe 40 and a sprinkler with baffle 30, wherein the function of the sprinkler head is affected by torn packaging material 70 stuck at the sprinkler head.

Such influences and damages of the sprinklers can cause high damage by malfunction of the sprinkler system.

SUMMARY

It is an object of the present invention to provide a mechanically simple solution for preventing damages of the sprinkler system when stored goods are placed into or respectively released from stock.

This object is solved by a protection device according to claim 1.

The proposed protection device comprises a mounting portion for mounting to the sprinkler system and a protection portion adapted to at least partially surround the baffle and/or the sprinkler head. If such protection devices are mounted to the sprinklers or at least to sprinklers likely to be damaged, the baffle and the sprinkler head are protected by the protection portion which at least partially surrounds them, so that damage of the baffle or respectively the sprinkler head can be prevented.

Preferably, the mounting portion may comprise mounting means by which the protection device can be mounted at a ceiling portion neighbouring the baffle and/or the sprinkler head or at an extinguishing agent supply pipe of the sprinkler system neighbouring the baffle and/or the sprinkler head.

Preferably, the mounting means may comprise at least a pipe clamp which may be formed of two half clamps.

In a preferred embodiment two pipe clamps may be provided in a manner that one pipe clamp can be mounted at the downstream and respectively upstream side of the supply pipe, so that the mounting portion at least partially surrounds the baffle and/or the sprinkler head.

The protection portion may preferably be formed of a protection bar and/or a protection grill and connected to the mounting portion. The protection bar may preferably comprise at least a hoop guard provided so as to at least partially surround the baffle and/or the sprinkler head.

Thereby, at least one hoop guard may be formed in a substantially U-shaped manner, wherein it may be connected by the free legs to the mounting portion, particularly the pipe clamps. The shape of the hoop guard may be designed so that the sprinkler head as well as the baffle is protected. Thereby, it can be assured that the baffle is not damaged either and that thereby the directivity of the sprinkler is not changed.

Furthermore, in an installation situation, the portion connecting the two legs of the U-shaped hoop guard may preferably be formed straight and substantially parallel to the supply pipe. Then, in the installation situation, at least one portion of the hoop guard may extend from the mounting portion over a baffle.

As an alternative, two or more hoop guards may be provided, which extend on one side of the baffle and/or the sprinkler head, respectively, in the installation situation.

Both hoop guards may thereby be formed identical in construction. Preferably, both hoop guards may be fixedly connected to each other. This may be achieved by means of a bar, which particularly connects the two crests of the U-shaped hoop guards to each other or which roughly connects the respective midpoints of the straightly formed portion connecting the legs. This leads to a stabilization of the protection portion and additionally to a protection against impacts from below towards the sprinkler head.

A free end of the protection bar may comprise a thread, e.g. the ends of the legs of the at least one U-shaped hoop guard, preferably an external thread, so that the protection bar is connected to the mounting portion via a screw coupling. The protection bar may then comprise a threaded bar, for example. Preferably, the ends of the protection bar, which comprise the thread, may each interact with a pipe clamp, so that the pipe clamp can be fixed to the supply pipe by means of the ends with the thread and the height of the protection bar above the sprinkler can be adjusted individually. Thereby, the protection device can be adapted to a changed installation situation or sprinkler design by just a few simple steps.

As an alternative to the hoop guard embodiment, the protection bar may as well comprise a circular guard ring which surrounds the baffle and is preferably arranged at about the height of the lower edge of the baffle or somewhat below.

BRIEF DESCRIPTION OF THE DRAWINGS

The invention will now be described in more detail based on embodiments with reference to the accompanying drawing figures, wherein.

DETAILED DESCRIPTION

In the following, a description of an embodiment of a sprinkler protection device comprising symmetrical hoop guards and a cross bar which connects them.

Figure 1:
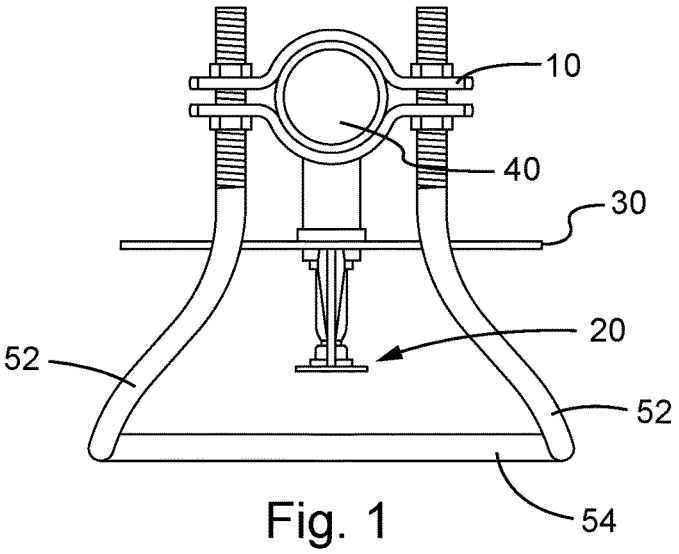
FIG. 1 shows a side view of a sprinkler with mounted protection device according to a first embodiment.

FIG. 1 shows a side view of the sprinkler protection device comprising two U-shaped hoop guards 52 mounted before and behind the sprinkler with sprinkler head 20 and baffle 30 at the string pipe or supply pipe 40 of the sprinkler system by means of a pipe clamp 10 with two half clamps. To this end, the respective ends of the hoop guards 52 comprise an external thread by which the pipe clamp 10 can be fixed via respective screw nuts. This provides a further advantage in that height or distance, respectively, of the hoop guard 52 with respect to the sprinkler head 20 is individually adjustable by the screw connection and that thereby the sprinkler protection device can be adapted in a simple manner to different sprinkler types and installation situation.

Of course, other kinds or means for fixing the protection device to the supply pipe 40 or the ceiling of the stockroom or the shelves are possible as long as the hoop guard 52 at least partially surrounds the baffle 30 and the sprinkler head 20, so that a damage of these by placing or respectively removing the stored goods into/from stock, can be prevented. In FIG. 1, the flaring shape of the hoop guard 52 transverse to the longitudinal axis of the supply pipe 40 is clearly visible, whereby the baffle 30 is also well protected against external impacts when the stored goods are placed into or removed from stock.

Furthermore, a bar-shaped cross stud 54 can be identified in FIG. 1, which has substantially the same diameter as the hoop guard 52 and which connects the two crests of the U-shaped hoop guard 52 to each other. In the present case, the cross stud 54 is located approximately in the middle of a straightly designed portion connecting the legs. Thereby, protection of the sprinkler head 20 from below is ensured as well and the whole protection device is stabilized in the lateral direction.

Figure 2:
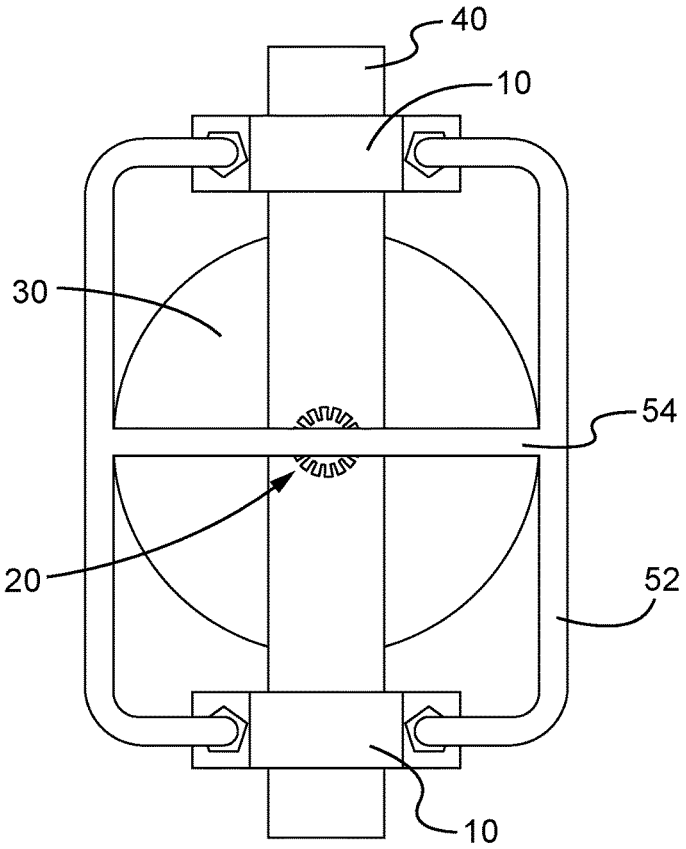
FIG. 2 shows a view from below on the sprinkler with mounted protection device.

FIG. 2 shows a view on the sprinkler with mounted protection device from below, wherein the protective effect of the cross stud 54 for the sprinkler head 20 is clearly visible. Also, the two pipe clamps 10 arranged before and behind the sprinkler in the direction of the supply pipe 40 are clearly visible here.

Figure 3:
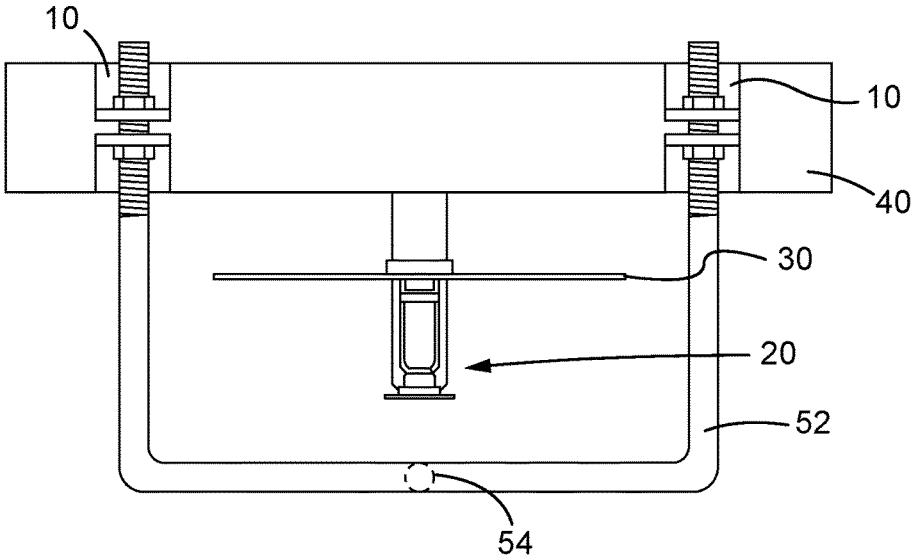
FIG. 3 shows a further side view perpendicular to the side view in FIG. 1 on the sprinkler with mounted protection device.

FIG. 3 shows a side view of the protection device according to the embodiment lateral to the longitudinal direction of the supply pipe 40. Here, it is clearly visible that the hoop guards 52 comprise the external thread at both of their outer ends of the legs, which is used for fixation of both of the pipe clamps 10 and for individual height adjustment of the hoop guard 52. Thereby, a simple construction and a fast mounting and adaptation with few mounting parts can be achieved.

Figure 4:
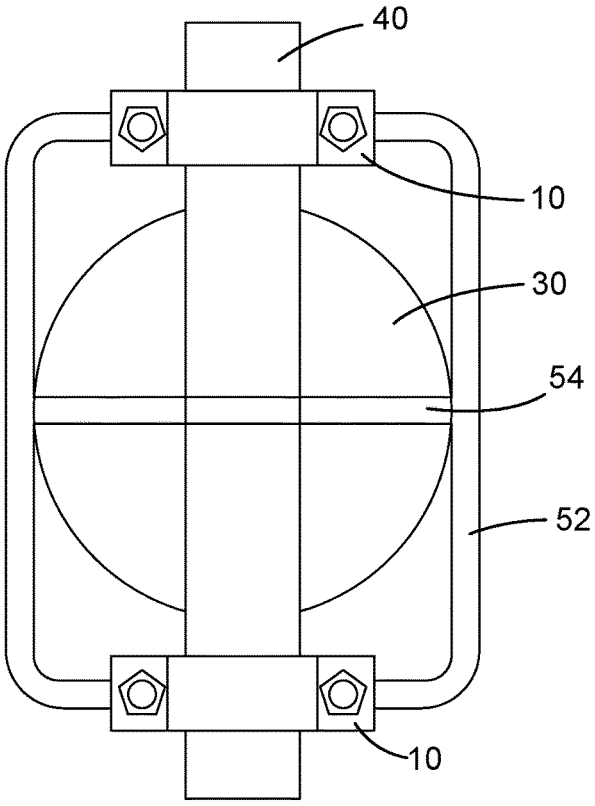
FIG. 4 shows a top view of the sprinkler with mounted protection device according to the first embodiment.

FIG. 4 shows a top view of the sprinkler comprising the protection device, wherein the sprinkler head is covered by the baffle 30 and the supply pipe 40 here.

Figure 5:
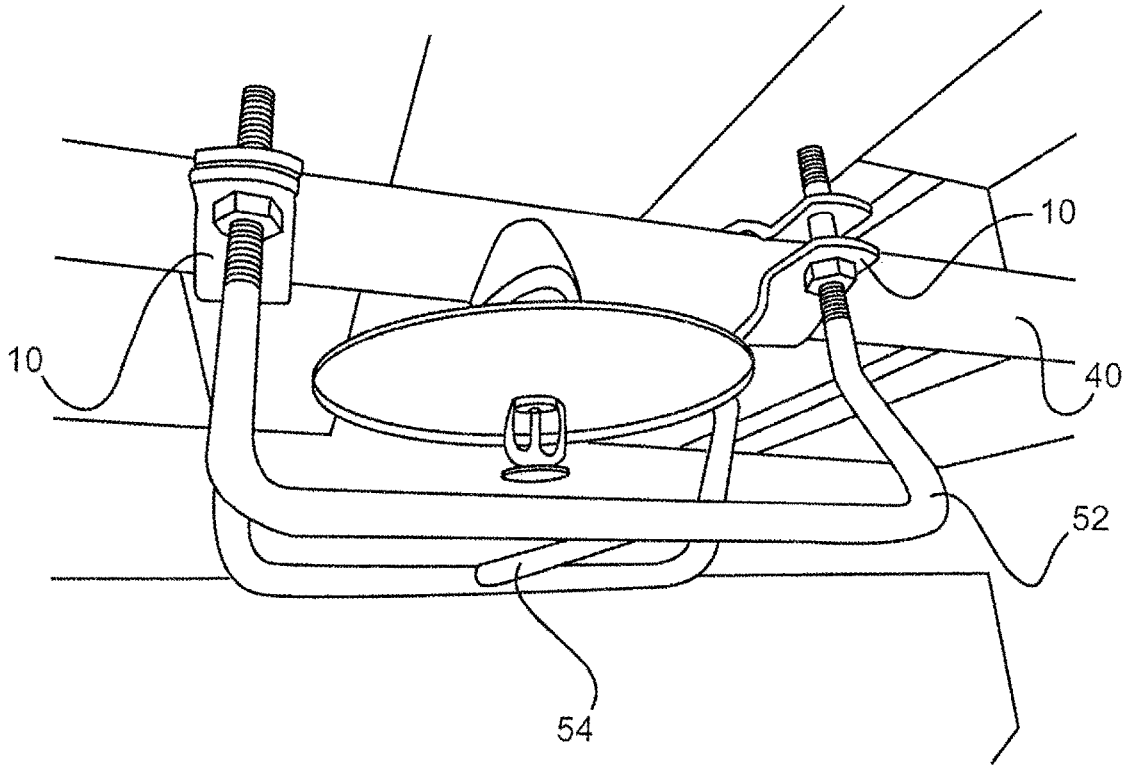
FIG. 5 shows a perspective view of a sprinkler with mounted protection device according to the first embodiment.

FIG. 5 shows a perspective view from an oblique angle from below on the supply pipe 40 comprising the protection device with hoop guards 52 and cross stud 45 mounted by two pipe clamps 10.

Figure 6:
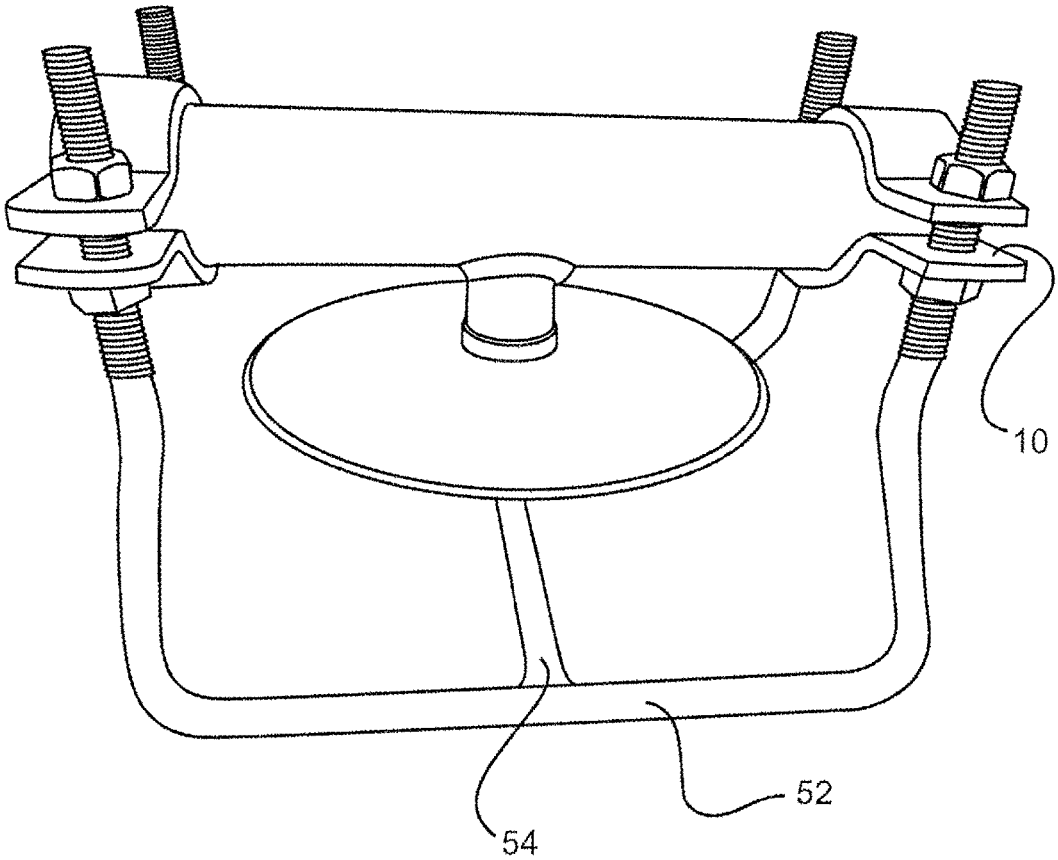
FIG. 6 shows a further perspective view of a sprinkler with mounted protection device and abutted stored goods.
Figure 7:
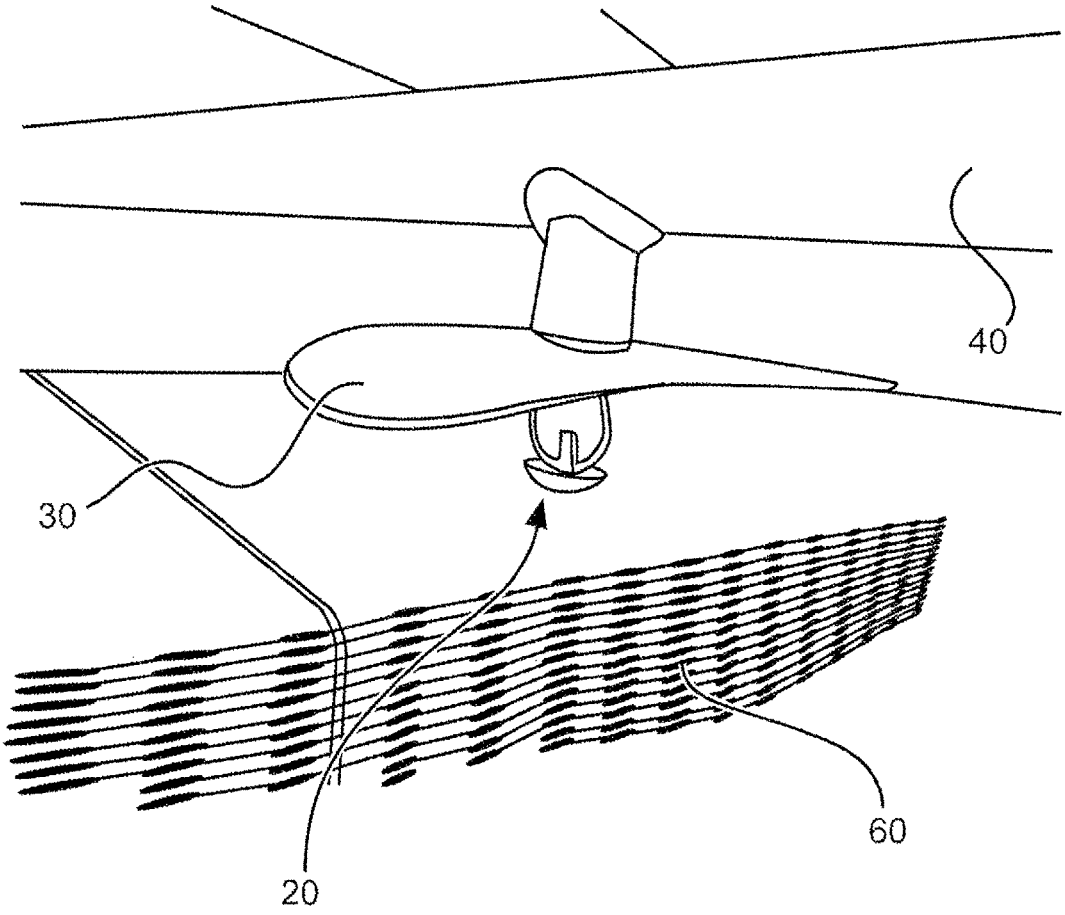
FIG. 7 shows a sprinkler with damaged baffle without protection device.
Figure 8:
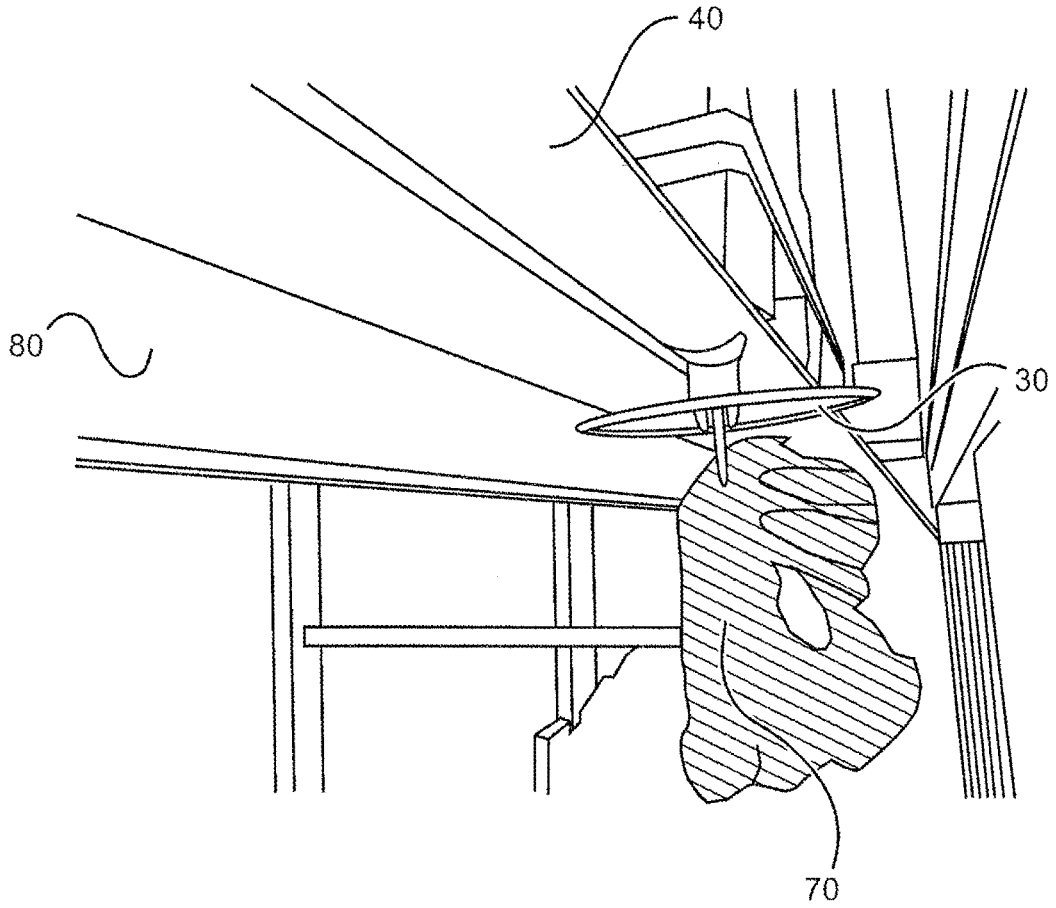
FIG. 8 shows a sprinkler with affected sprinkler head without protection device.

Finally, FIG. 6 shows the same device from an oblique angle from above, wherein the stored goods (e.g. wooden pallets) are kept away from the sprinkler head and the baffle by the hoop guard 52 and the cross stud 54, so that a damage thereof can be prevented.

Figure 9A:
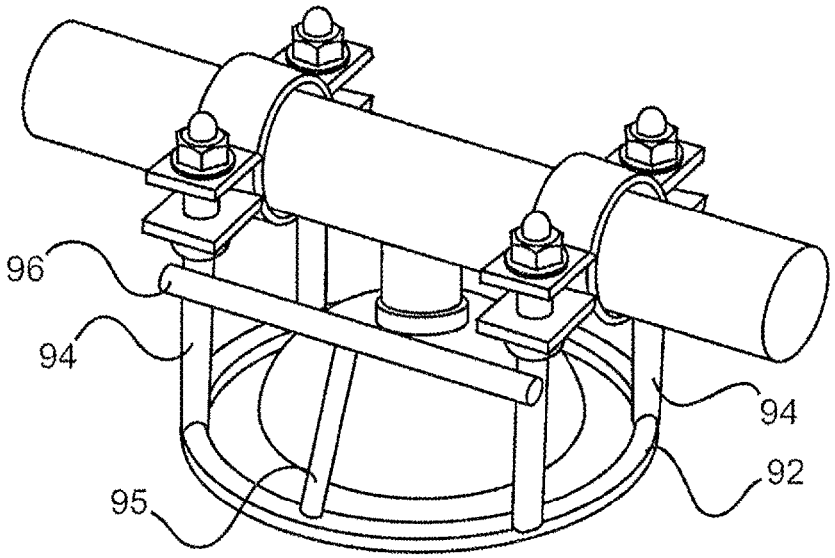
FIG. 9A shows a perspective view of a sprinkler with mounted protection device according to a second embodiment.

FIG. 9A shows a sprinkler protection device according to a second embodiment comprising a circular implementation of the protection portion, which is thereby adapted to the sprinkler baffle. Here, the protection portion is formed by a circular guard ring 92 which surrounds the baffle and preferably is arranged approximately at the height of the lower edge of the baffle. Perpendicular to the plane of the guard ring 92 fixing struts 94 are arranged, which preferably comprise threaded ends, so that similar to the first embodiment corresponding pipe clamps can be screwed at the protection portion, so that a simple fixation at a variable height level can be achieved. Furthermore, lateral cross struts 96 and optionally also a diagonally arranged auxiliary strut 95 can be provided for stabilization and as additional guard.

Figure 9B:
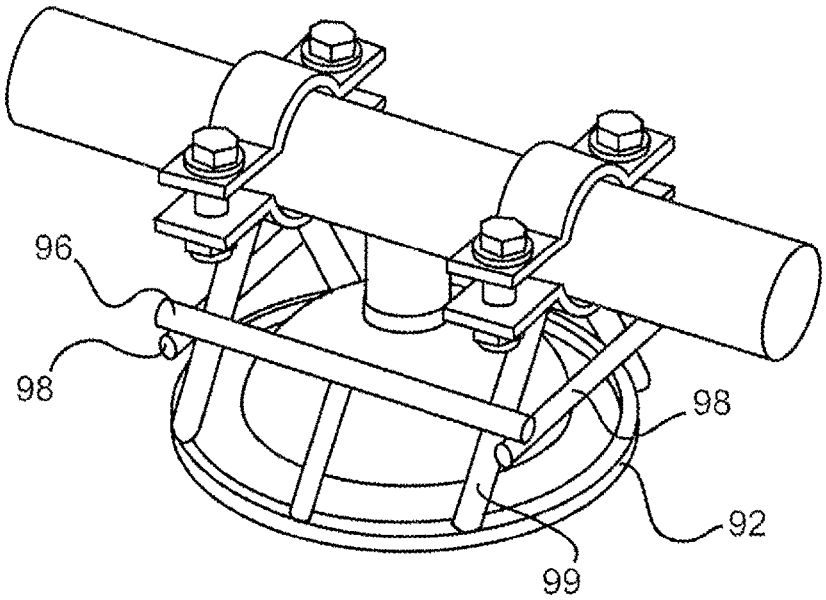
FIG. 9B shows a perspective view of a sprinkler with mounted protection device according to a modification of the second embodiment.

FIG. 9B shows a sprinkler protection device according to a modification of the second embodiment. Here, the protection portion is also formed by the circular guard ring 92 which is arranged approximately at the height of the lower edge of the baffle or somewhat below. Instead of the perpendicular fixing struts tilted fixing struts 99 are provided in the present modification, which are fixed to the fixing pipe clamps. Thus, a height adjustment of the protection device is no longer possible, as the distance between the guard ring 92 and the pipe clamps cannot be changed. Additionally, further cross studs 98 can be connected to the tilted fixing struts.

Figure 10A:
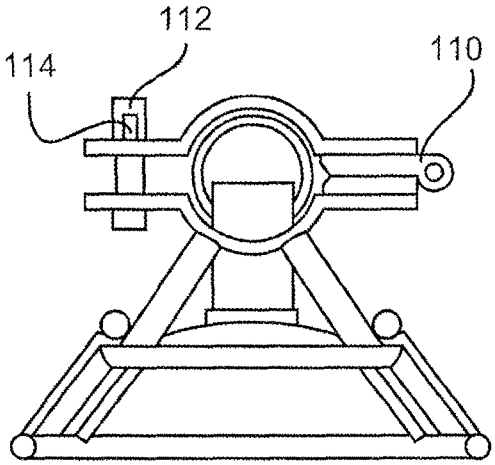
FIG. 10A shows a side view of the modified second embodiment with modified pipe clamp embodiment.
Figure 10B:
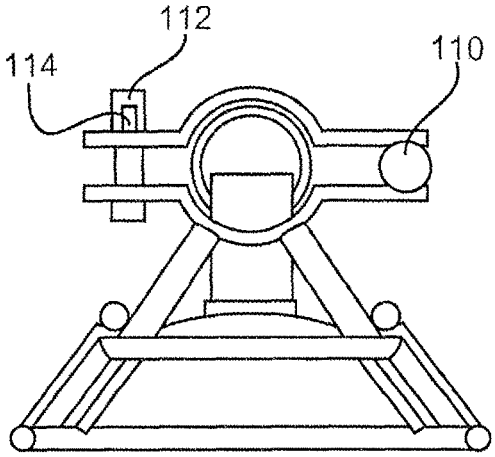
FIG. 10B shows a side view of the modified second embodiment with further modification of the pipe clamp embodiment.
Figure 10C:
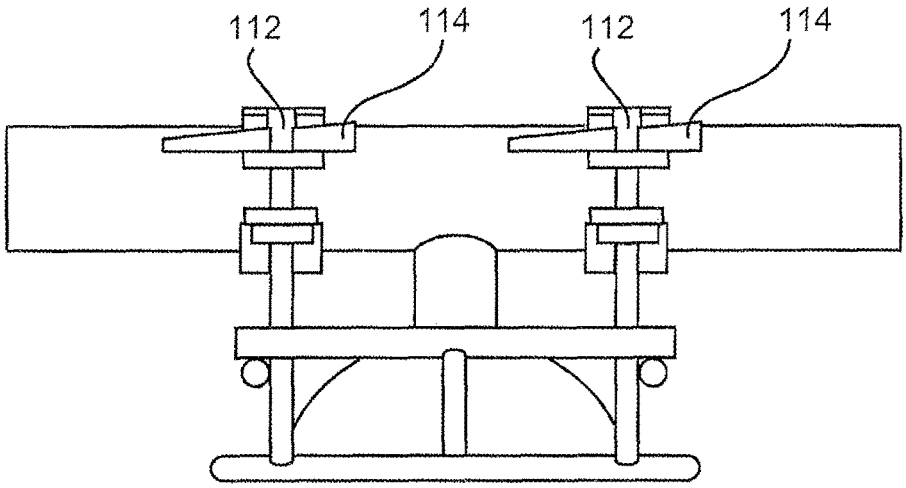
FIG. 10C shows a side view of the modified second embodiment rotated by 90° with respect to FIGS. 10A and 10B.

FIGS. 10A to 10C show different side views of two alternative embodiments of the fixing pipe clamps. Instead of the screw connection at both ends of the pipe clamps, a clamp-kind of fixation by means of a combination of a hinge element 110 and 111, respectively, and a wedge element 114 can be provided. Thereby, the hinge element is provided at one end of the respective pipe clamp and a bolt 112 with wedge-shaped plug element 114 plugged into a slit formed in the direction of the longitudinal axis of the bolt 112, which thereby presses both clamp ends arranged above each other with progressive insertion, so that the pipe clamp is clamped to the sandwiched supply pipe to thereby fix the sprinkler protection device. As can be gathered from FIG. 10A and 10B, the hinge element can be formed as hinge element 110 with own legs fixed at the pipe clamp or as hinge element 111 without own legs.

By means of the protection device according to the invention bending or damaging of the baffle as well as tearing, damaging or affecting the sprinkler head can be prevented by individual adaptivity to the insolation situation and the sprinkler implementation.

Finally, it is to be noted that the above-described embodiment merely forms one of many implementation options of the protection device. Thus, the protection device may for example be implemented without the cross stud 54 and with only one hoop, to ensure at least a minimum protection. Also, the hoop construction with the cross stud can be replaced by a protection grill surrounding the sprinkler head 20 and the baffle 30, which can be fixed at the supply pipe 40 or the ceiling of the storeroom or the shelves or shelf bars, respectively. The pipe clamps 10 can be replaced by various other mechanical or chemical fixation means. Also, the shape of the hoop guard can be designed differently, circular or rectangular or elliptical, for example, as long as abutting of the stored goods to the sprinkler head 20 and/or the baffle 30 can be prevented. Instead of the cross stud 54 several cross studs or a grill can be provided at the lower side of the protection device.

The invention claimed is:

1. A protection device for protecting a baffle or a sprinkler head of a fire sprinkler system, comprising:

at least one pipe clamp configured to mount the protection device to a supply pipe to protect the baffle or sprinkler head; and a protection bar configured to surround the baffle or the sprinkler head, the protection bar including a first threaded portion which directly engages the pipe clamp, the first threaded portion being secured to the at least one pipe clamp by correspondingly threaded first fasteners;

said protection device further comprising another pipe clamp which is configured to be directly connected to a second threaded portion of the protection bar and secured thereto by correspondingly threaded second fasteners, wherein the two pipe clamps are provided in a manner that one respective pipe clamp can be mounted at the supply pipe on each side downstream and upstream of the baffle or the sprinkler head.

2. The protection device according to claim 1, wherein each pipe clamp is formed of two half clamps.

3. The protection device according to claim 1, wherein the protection bar comprises at least one hoop guard adapted to surround the baffle or the sprinkler head.

4. The protection device according to claim 3, wherein the at least one hoop guard is formed in a U-shaped manner and is connected to a mounting portion, in particular the pipe clamps, by means of the free legs.

5. The protection device according to claim 4, wherein a connecting portion of the legs of the U-shaped hoop guard is formed in a straight manner and extends substantially parallel to the supply pipe in an installation situation.

6. The protection device according to claim 4, wherein two hoop guards are provided, each of which extends on one side of the baffle or the sprinkler head in the installation situation.

7. The protection device according to claim 6, wherein the two hoop guards are arranged in identical construction.

8. The protection device according to claim 6, wherein the two hoop guards are fixedly connected to each other.

9. The protection device according to claim 8, wherein the hoop guards are connected by means of a bar which particularly connects the two crests of the U-shaped hoop guards to each other or roughly connects the respective mid points of the straightly arranged portion which connects the legs.

10. The protection device according to claim 3, wherein the at least one hoop guard extends from the first and second threaded portions to a position above the baffle.

11. The protection device according to claim 1, wherein the first and second threaded portions each interact with the respective pipe clamp whereby the protection bar can be individually adjusted in its height above the sprinkler.

12. The protection device according to claim 1, wherein the protection bar comprises a circular guard ring which surrounds the baffle or the sprinkler head and which is arranged at a height of the lower edge of the baffle or below.

* * * * *